US005202696A

United States Patent [19]

Sheriff

[11] Patent Number: 5,202,696

[45] Date of Patent: Apr. 13, 1993

[54] END FED HALF WAVE DIPOLE ANTENNA

[76] Inventor: Jack W. Sheriff, 2167 Calle Guaymas, La Jolla, Calif. 92037

[21] Appl. No.: 793,555

[22] Filed: Nov. 18, 1991

[51] Int. Cl.[5] ..... H01Q 11/14

[52] U.S. Cl. ..... 343/741; 343/744; 343/749; 343/859; 343/861

[58] Field of Search ..... 343/722, 749, 741, 744, 343/803, 825, 790–792, 859, 860, 861

[56] References Cited

U.S. PATENT DOCUMENTS 2,472,106 6/1949 Hansen ..... 343/741
3,716,861 2/1973 Root ..... 343/741

*Primary Examiner*—Michael C. Wimer

*Attorney, Agent, or Firm*—Frank D. Gilliam

[57] ABSTRACT

A low cost, high efficiency, end fed half wave folded dipole radio frequency antenna. The antenna includes an improved balun including a conductive tubular base secured to a conventional coaxial cable connector, a conductive tube telescoped relative to the base with a slot between the base and tube having an area corresponding to the extent the tube and base are telescoped together and two wires within the tube connected to the coaxial connector and each having an insulating sleeve. A folded wire loop antenna is connected to the wires and extends away from the balun. The loop may include coils to improve the gain of the antenna. A tubular insulating housing encapsulates the antenna.

15 Claims, 1 Drawing Sheet

END FED HALF WAVE DIPOLE ANTENNA

BACKGROUND OF THE INVENTION

This invention relates in general to radio frequency antennas and, more specifically, to an improved, high efficiency, low cost end fed half wave folded dipole antenna.

A wide variety of antennas have been developed for use in sending and receiving radio signals. These range from a very simple long wire antenna to very small electronically complex antennas. Antennas are generally optimized for the frequency range to be used and the particular type of transmissions involved.

Recently, there has been increased interest in small, low cost antennas for applications such as cellular telephones, alarm systems and the like. Alarm systems that automatically transmit an alarm signal in such circumstances as a breaking and entry, triggered by a person having a medical emergency, or in response to other problems so that an appropriate response can be made from a central station are coming into greater use. Since a multiplicity of sensors may each have its own signal transmission system, it is important that the system and associated antenna be both inexpensive and efficient.

Simple, fractional wave length, e.g. half wave, antennas are often used. However, these antennas are difficult to precisely tune to a desired wavelength and do not have optimum gain and frequency response.

More complex small antennas are widely used in cellular telephone systems. Typical of these are the antennas described by Sheriff in U.S. Pat. No. 4,975,713. While very compact and effective, they are generally more complex and expensive than would be desirable in a multi-antenna alarm system.

Thus, there is a continuing need for small compact antennas of increased performance and lower cost for use in applications such as alarm systems.

SUMMARY OF THE INVENTION

It is, therefore, an object of this invention to provide a radio frequency antenna overcoming the above-noted problems. Another object of this invention is to provide an end fed half wave folded dipole antenna of lower cost. Still another object is to provide a radio frequency antenna with simple means for precisely tuning the antenna to a selected frequency. Yet another object is to provide a folded dipole antenna having a simple and efficient means for increasing gain and a pattern perpendicular to the dipole axis.

The above-noted objects, and others are accomplished in accordance with this invention by an end fed half wave folded dipole antenna having an upstanding tubular base fastened to a conventional radio frequency connector, two wires positioned within the base and connected to the connector, insulating sleeves around the wires, a conductive tube adjustable in height relative to the base, and a full wave wire length loop antenna connected to the two wires.

At least one slot is provided in said tube and/or base which allows for fastening at the optimum height as the tube is telescoped together or apart for tuning. The antenna can be precisely tuned for a selected frequency by varying the height of the tube. The base and tube are fastened together when the optimum tube height is established.

The entire assembly may be housed in a tubular insulating housing. Preferably, a quantity of flexible plastic foam material is wrapped around the loop antenna in the housing and is placed between the wires and the tube to prevent damage as the antenna is moved or dropped.

In order to increase gain (about +3 dbd) and change the antenna pattern the opposite sides of the antenna wire may be coiled in a region intermediate the ends of the loop. In this embodiment, the loop typically has an overall wire length of about 3 times the selected wavelength, with two opposed coils, each having a coil length of about 0.20 wavelength, formed in the antenna wire. Other coil configurations may be used, if desired. In the preferred embodiment detailed below, the coil stands slightly above one half wave length from the top of the balun sleeve.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
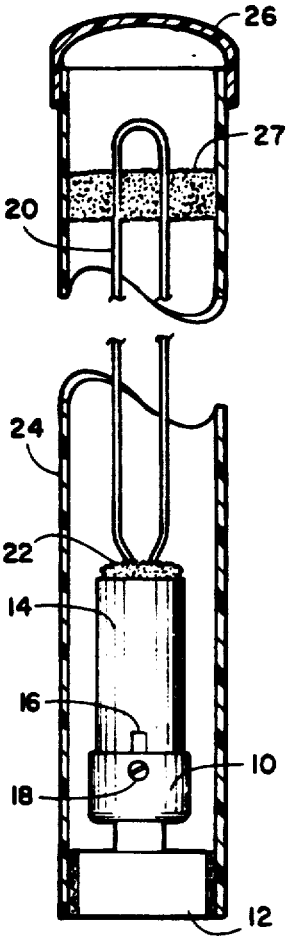
FIG. 1 is a schematic elevation view of a first embodiment of the complete antenna of this invention, with the housing partially cut away.

Referring now to FIG. 1, there is seen a first embodiment of the antenna of this invention in complete form, with the enclosure or housing cut away to reveal internal components. Base 10 is a tubular or cup shaped conductor, typically a conventional copper tubing end cap with a hole in the end. Base 10 is fastened to a conventional radio frequency connector 12 of the sort used for connecting a device to a coaxial cable and having two contacts extending toward the inside of base 10.

A conductive tube 14, typically a piece of standard 0.5 inch diameter copper tubing, is telescoped into base 10. Of course, tube 14 could be telescoped over base 10, if desired. Internal components within tube 14, which with tube 14 form a variable balun, are detailed in FIG. 2, below. At least one, preferably two, slots 16 are provided in tube 14, which are located to extend into base 10. Tube 14 is secured to base 10 by bolts 18 engaging nuts (not seen) within tube 14 through slots 16. The position of tube 14 relative to base 10, i.e. the relative height of the tube 14, determines the precise peak frequency of the antenna and is adjusted after the antenna is assembled. While tube 14 may have any suitable length, in general a length of about one quarter wavelength is optimum.

A folded dipole antenna loop 20 extends from within tube 14. A quantity of flexible plastic foam material 22 is packed into the top of tube 14 around the wires exiting the tube to prevent damage if the antenna is jolted.

The antenna components are surrounded and encapsulated in a housing consisting of an insulating tube 24 and cap 26. Tube 24 may typically be 1 inch polyvinyl chloride (PVC) pipe and cap 26 may be a conventional PVC pipe cap, adhesively bonded tube 24. A quantity of flexible plastic foam 27, typically styrofoam, is wrapped around loop 20 and fills the space between loop 20 and tube 24 to maintain the loop in the desired position. A conventional plastic bonding cement and filler is used to bond the open end of tube 24 to electrical connector 12. Typical of these cements is the polyester material sold under the Bondo trademark.

Figure 2:
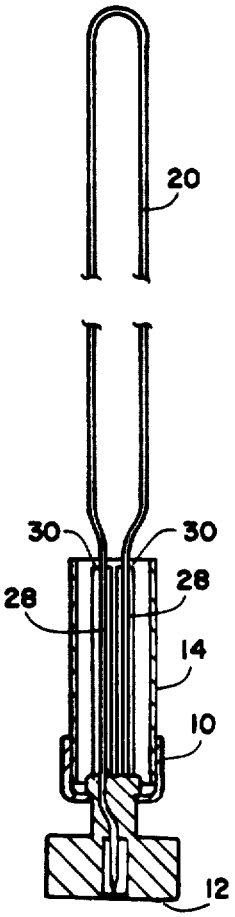
FIG. 2 schematic elevation view of the antenna internal components, with portions cut away.

The internal components within tube 14, which with tube 14 form a balun, are detailed in FIG. 2. Two thin wires 28 are positioned within tube 14. One wire 28 is soldered to the ground contact of connector 12, which also grounds base 10 and tube 14. The other wire 28 is connected to the center coaxial contact of connector 12. The opposite ends of wires 28 are connected to the ends of loop 20. Wires 28 may have any suitable diameter and length. Preferably, each wire 28 is a copper wire having a length of about one quarter of the selected optimum wavelength and having a diameter of about 0.064 inch.

A plastic sleeve 30 is slipped over each of wires 28. Preferably, sleeves 30 are 0.015 inch wall thickness Teflon fluorocarbon tubes having inside diameters that snugly fit wires 28. If desired, the sleeves 30 may be held in place by adding a tube of conventional heat shrink tubing over both sleeves 30 and heating to shrink the tubing over the wires and sleeves.

The balun formed by base 10, tube 14 and the internal components typically transforms the impedance from unbalanced 50 ohm coaxial cable at connector 12 to balanced 250 ohm open wire transmission line shorted at the half wave length point. The balun first establishes the transformation impedance which is the square root of the product of the antenna impedance (250 ohms) and the coax (50 ohms) or 112 ohms. The close fitting sleeves 30 over wires 28 give an approximate impedance of 276 log ($2\times0.094/0.064$) or 129 ohms. When this area is covered with the copper tube 14 the impedance is reduced to the proper value and allows the antenna to be precisely tuned to the center of the desired frequency band for a perfect 1/1 voltage standing wave ratio (VSWR) by variation of the areas of slots 16.

Figure 3:
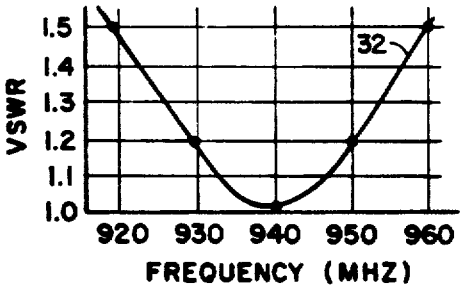
FIG. 3 is a graph showing VSWR versus frequency for the antenna of FIG. 1.
Figure 4:
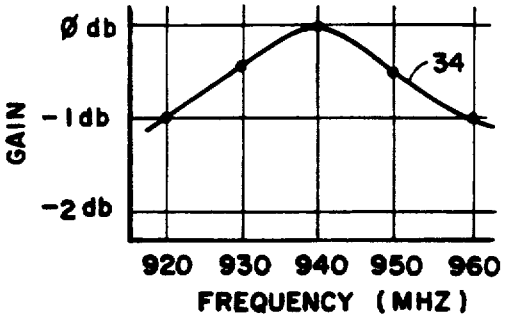
FIG. 4 is a graph showing gain versus frequency for the antenna of FIG. 1.

A typical curve 32 of VSWR versus frequency is provided in FIG. 3. As can be seen, the VSWR of curve 32 ranges from about 1.5 to 1.0 over the frequency band of interest here, namely 920 to 960 MHZ. Curve 34 as shown in FIG. 4 shows that the gain varies only between 0 and $-1$ db over the 920–960 MHZ frequency band. This course, be optimized for other selected frequency bands. This is a simple, inexpensive and high performance antenna suitable for many applications, such as alarm systems.

Figure 5:
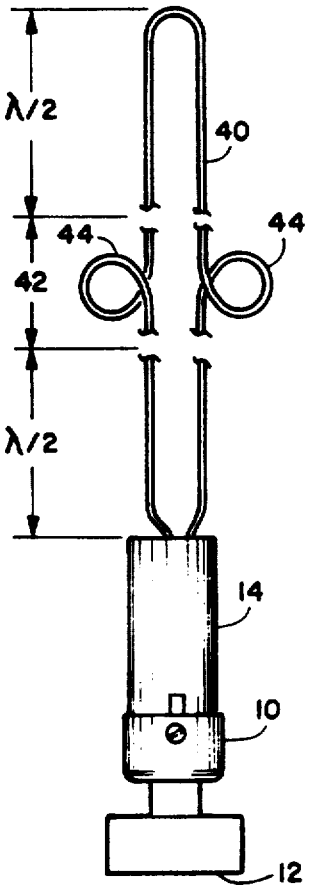
FIG. 5 is a schematic elevation view of a second embodiment of the antenna of this invention.

A second embodiment of the end fed folded dipole antenna of this invention is shown in FIG. 5. Here, the internal components within tube 14, i.e. the balun, are the same as those described above. In this embodiment, loop 40 has an overall length equal to about 1.5 times the selected wavelength, rather than 0.5 wave length of the embodiment of FIGS. 1 and 2. The loop 40 has two end sections having lengths of about 0.5 wave length and a center section 42 which had a length of about 0.5 wave length which has been formed into a pair of coils 44. Each coil preferably has a length of slightly less than that 0.25 wave length. The coils do not touch at the cross over point. In each coil, a parallel equivalent circuit is formed with the impedance in the coil in parallel with the capacitance between the closely spaced wires at the coil cross over point. This parallel resonant circuit is tuned above the selected antenna frequency band. Series and parallel resonances in the loop are reverse in their reactive impedance before and after resonance, resulting in the loop acting as a parallel resonant circuit whose resonant frequency is above the antenna frequencies of interest and therefore an inductance below that resonant frequency. This yields a net impedance for the antenna over a $\pm3\%$ bandwidth for a VSWR of 1.5, maximum.

Figure 6:
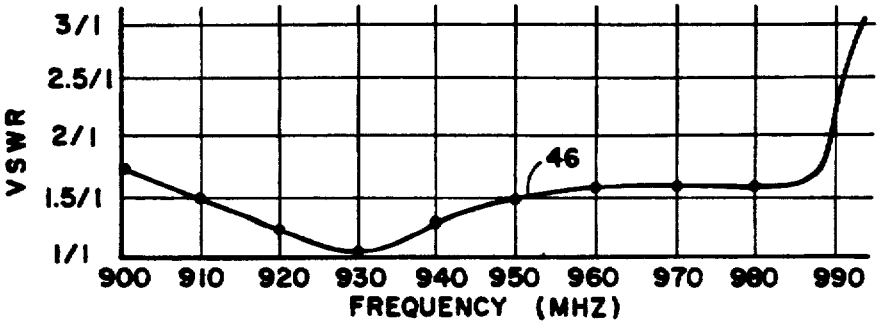
FIG. 6 is a graph showing VSWR versus frequency for the antenna of FIG. 5.

The expanded bandwidth provided by the embodiment of FIG. 5 is graphically shown in FIG. 6. Curve 46 has an effective The expanded bandwidth provided by the embodiment of FIG. 5 is graphically shown in FIG. 6. Curve 46 has an effective bandwidth of from about 900 to 990 MHZ. This configuration converts the antenna into a high gain version with a pattern perpendicular to the antenna axis and $+3.3$ Db gain.

While certain preferred arrangements, conditions and dimensions are detailed in the above description of preferred embodiments, these may be varied, where suitable, with similar results. For example, dimensions will vary depending on the frequency band of interest. The diameter and positioning of coil 44 may similarly be varied to change antenna characteristics.

Other applications, variations and ramifications of this invention will occur to those skilled in the art upon reading this disclosure. Those are intended to be included within the scope of this invention, as defined in the appended claims.

I claim:

1. A low cost, high efficiency, end fed half wave folded dipole antenna which comprises:

an upstanding tubular electrically conductive base;

means for connecting two electrically isolated electrical connections to an external electrical cable secured to said base;

two conductive wires extending from within said base and connected to said electrical connections;

sleeves of electrical insulating material surrounding each of said wires to lower the antenna impedance;

an electrically conductive tube telescoped relative to said base and substantially surrounding said two wires;

at least one slot between said tube and said base, an externally exposed area of said slot, said exposed area being dependent on the extent to which said tue is telescoped relative to said base;

means for fastening said tube to said base with a selected exposed area of said slot; and an electrically conductive wire loop connected to and extending from said two wires.

2. The end fed half wave folded dipole antenna according to claim 1 wherein said wire loop has a length corresponding to a half wave at the selected radio frequency.

3. The end fed half wave folded dipole antenna according to claim 1 wherein said wire loop has a length corresponding to one and one half wave at the selected radio frequency and then has a coil formed in opposite sides of said loop, each coil having a length of slightly over one quarter wave to form a parallel resonant circuit.

4. The end fed half wave folded dipole antenna according to claim 1 further including a tubular electrically insulating closed tubular cover enclosing said base, tube and antenna with said connecting means exposed at one end for connection to an electrical cable.

5. The end fed half wave folded dipole antenna according to claim 4 further including a quantity of flexible foam electrically insulating material wrapped around said antenna and supporting said antenna in said tubular cover and a further quantity of flexible foam electrically insulating material between said wires and said tube supporting said wires against shock or impact.

6. The end fed half wave folded dipole antenna according to claim 1 wherein said sleeves are formed from fluorocarbon resin sleeves closely fitting said wires.

7. The end fed half wave folded dipole antenna according to claim 6 wherein said wires are formed from 0.064 inch diameter copper wire and said sleeves have thicknesses of about 0.015 inch.

8. The end fed half wave folded dipole antenna according to claim 1 wherein said tube is formed from 0.5 inch diameter copper pipe.

9. A low cost, high efficiency, end fed half wave folded dipole antenna which comprises:

an upstanding tubular electrically conductive base;

means for connecting two electrically isolated electrical connections to an external electrical cable secured to said base;

two conductive wires extending from within said base and connected to said electrical connections;

sleeves of electrical insulating material surrounding each of said wires to lower the impedance of said antenna;

an electrically conductive tube telescoped relative to said base and substantially surrounding said two wires;

at least one slot between said tube and said base, an externally exposed area of said slot dependent on the extent to which said tube is telescoped relative to said base;

means for fastening said tube to said base with a selected area of said at least one slot being externally exposed;

an electrically conductive wire loop connected to and extending from said two wires; and a coil formed in each of the opposite sides of said conductive wire loop.

10. The end fed half wave folded dipole antenna according to claim 9 wherein said wire loop has a length corresponding to one and one half wave at the selected radio frequency and, each of said coils has a length of slightly less than one quarter wave to form a parallel resonant circuit.

11. The end fed half wave folded dipole antenna according to claim 9 further including a tubular electrically insulating closed tubular cover enclosing said base, tube and antenna with said connecting means exposed at one end for connection to an electrical cable.

12. The end fed half wave folded dipole antenna according to claim 11 further including a quantity of flexible foam electrically insulating material wrapped around said antenna and supporting said antenna in said tubular cover and a further quantity of flexible foam electrically insulating material between said wires and said tube supporting said wires against shock or impact.

13. The end fed half wave folded dipole antenna according to claim 9 wherein said sleeves are formed from fluorocarbon resin sleeves closely fitting said wires.

14. The end fed half wave folded dipole antenna according to claim 13 wherein said wires are formed from 0.064 inch diameter copper wire and said sleeves have thicknesses of about 0.015 inch.

15. The end fed half wave folded dipole antenna according to claim 9 wherein said tube is formed from 0.5 inch diameter copper pipe.

* * * * *